US007117921B2

(12) United States Patent
Marandon et al.

(10) Patent No.: US 7,117,921 B2
(45) Date of Patent: Oct. 10, 2006

(54) DEVICE HAVING SEVERAL POINTS OF CLOSURE SECUREMENT FOR A SECTIONAL CLOSURE

(75) Inventors: Alban Nicolas Marandon, Attichy (FR); Philippe Charles Legris, Sailly Fubeaucourt (FR)

(73) Assignee: Stremler, Nouvion (FR)

( * ) Notice: Subject to any disclaimer, the term of this patent is extended or adjusted under 35 U.S.C. 154(b) by 0 days.

(21) Appl. No.: 10/975,344

(22) Filed: Oct. 29, 2004

(65) Prior Publication Data

US 2005/0199354 A1 Sep. 15, 2005

(30) Foreign Application Priority Data

Oct. 31, 2003 (FR) ..... 03 12787

(51) Int. Cl.
*E05D 15/26* (2006.01)

(52) U.S. Cl. ..... 160/229.1

(58) Field of Classification Search ..... 160/201, 160/209, 234
See application file for complete search history.

(56) References Cited

U.S. PATENT DOCUMENTS

| | | | | |
|---|---|---|---|---|
| 2,189,020 | A * | 2/1940 | Rowe | 160/40 |
| 2,217,437 | A * | 10/1940 | Ferris et al. | 160/209 |
| 5,445,207 | A * | 8/1995 | Romanelli et al. | 160/209 |
| 5,819,834 | A | 10/1998 | Wedekind | |

FOREIGN PATENT DOCUMENTS

| | | |
|---|---|---|
| DE | 197 19 144 | 11/1997 |
| DE | 298 22 721 | 5/1999 |
| EP | 0 937 852 | 8/1999 |
| FR | 2 808 553 | 11/2001 |

* cited by examiner

*Primary Examiner*—David Purol
(74) *Attorney, Agent, or Firm*—Young & Thompson

(57) ABSTRACT

A device with several points of closure securement, particularly for a sectional closure, of the type comprising a central bolting member (1) for example a lock, and at least one blade (2) for actuating a closure securement block (3). Each actuating blade (2) is in at least two portions (4*a*, 4*b*) connected successively by a connecting member (5) with double articulation (6*a*, 6*b*), so as to permit the articulation of the sections (A, B) of the closure at least in the open and closed positions of the closure.

9 Claims, 4 Drawing Sheets

DEVICE HAVING SEVERAL POINTS OF CLOSURE SECUREMENT FOR A SECTIONAL CLOSURE

BACKGROUND OF THE INVENTION

1. Field of the Invention

The invention relates to a device with several points for securing a closure, particularly for a sectional closure.

The invention is particularly useful for bolting a sectional garage door, a wide doorway flap, or any other sectional closure adapted to be articulated during its opening.

2. Description of the Related Art

There are known devices with several points as closure securement for metallic constructions. This type of device has a bolting block for each point of closure securement. This bolting block can be inserted and raised into a cutout in the metallic construction by means of a headpiece. The bolting blocks are generally interconnected by at least one actuating blade sliding in the plane of the headpiece. The headpiece can preferably be cut out or recessed to permit the sliding of the actuating blade, whose ends are thus slidably mounted relative to the interior of U shaped configurations provided in the headpiece. This device of known type is satisfactory, but cannot be used for bolting a sectional closure.

SUMMARY OF THE INVENTION

The invention has for its object to improve the prior art, by providing a new device usable for the bolting of a sectional closure, both in the open position and in the closed position of the closure.

The invention has for its object a device with several points of closure securement, particularly for sectional closures, of the type comprising a central bolting member, for example a lock, and at least one actuating blade for point of closure securement, characterized by the fact that each actuating blade is discontinuous in at least two portions successively connected by a double articulated connecting member, so as to permit the articulation of the sections of the closure at least in the open end of the closed position of the closure.

According to other alternative characteristics of the invention:

- the spacing of the articulations of the double articulation of the connecting member corresponds substantially to the path of the actuating member.
- the articulations of the double articulation are preferably substantially coplanar with the articulation of the sections or panels of the closure, when these sections or panels are aligned.
- the double articulated connection member can constitute an intermediate connecting rod in the aligned position of the sections or panels of the closure, and an intermediate articulation rod in the articulated position of the sections or panels of the closure.
- the double articulated connection member can be configured as a crosspiece with two force transmitting surfaces adapted to coact with the corresponding surfaces of the portions of the actuating blades.
- the coincidence of the axis of the hinge for articulating the sections or panels of the closure, and an articulation of the connection member, is preferably obtained in the articulated position of the closure, when these sections or panels are aligned and when the closure is in the bolted or unbolted position.

BRIEF DESCRIPTION OF THE DRAWINGS

The invention will be better understood from the following description, given by way of non-limiting example, with reference to the accompanying drawings, in which:

With reference to FIGS. 1 to 4, identical or functional equivalents are given identical reference numerals.

DETAILED DESCRIPTION OF THE PREFERRED EMBODIMENTS

Figure 1:
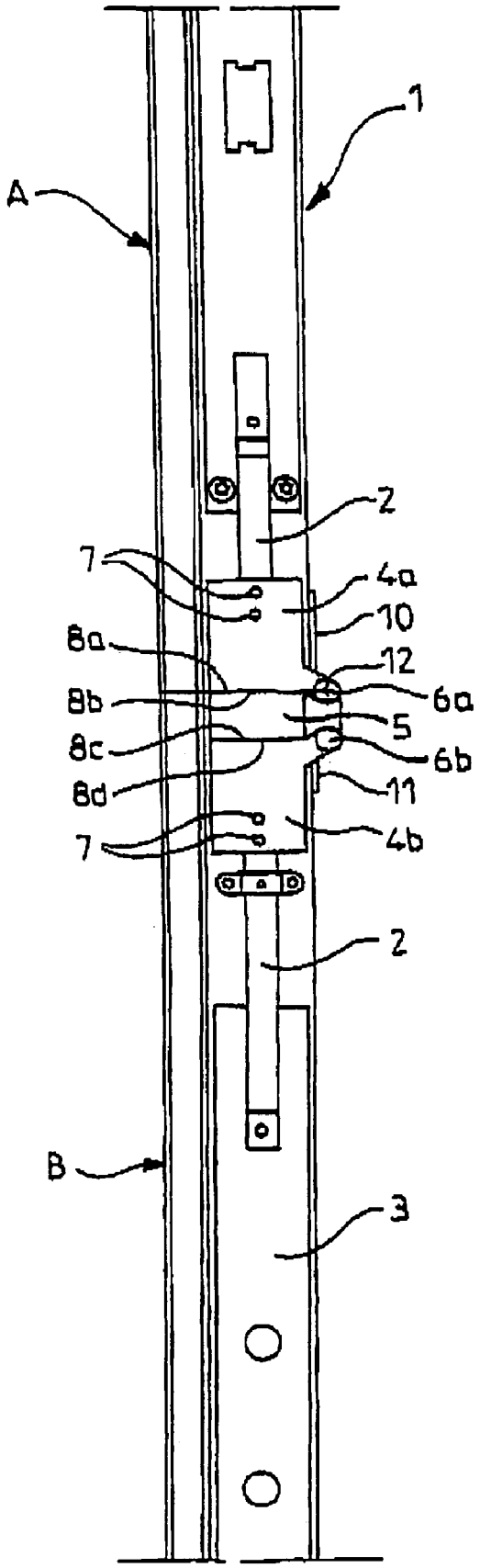
FIG. 1 shows schematically a side view of a closure with aligned panels, provided with a device according to the invention in the bolted position.

In FIG. 1, a device according to the invention comprises a central bolting member 1, for example a lock, adapted to control the movement of an actuating blade 2 connected to a closure securing lock 3.

The central bolting member 1, in this case a lock, comprises, in a manner known per se, a central housing containing a mechanism and two bolts: a half-turn bolt and a rectangular bolt.

The actuating blade 2 is connected, in a manner known per se, to a reverser or actuator of the central housing, by one or several screws (not shown).

The actuating blade 2 can be held, in a manner known per se, by one or several slides against the edge of one or several panels A, B of the closure or the door.

These panels A, B of the closure or door can be articulated to each other about a geometric axis 12 of articulation, for example by means of a hinge.

The blade 2 is interrupted by a first portion 4*a* and a second portion 4*b*, interconnected by a connecting member 5.

The connecting member 5 is a double articulation member: a first articulation 6*a* with the first portion 4*a* and a second articulation 6*b* with the second portion 4*b*.

The portions 4*a* and 4*b* are secured to the ends of the actuating blade 2 permanently, for example by means of rivets 7.

In the position of FIG. 1, the transmission of the bolting force takes place preferably by the bearing against each other of several force transmitting surfaces: a first surface 8*a* delimiting the portion 4*a*, a second surface 8*b* delimiting the upper end of the connecting member 5, a third surface 8*c* delimiting the lower end of the connecting member 5, and a fourth surface 8*b* delimiting the portion 4*b*.

This arrangement has the advantage of causing the connecting member 5 to act in the manner of a crosspiece for transmitting bolting force exerted by the lock 1 on the actuating blade 2.

Figure 2:
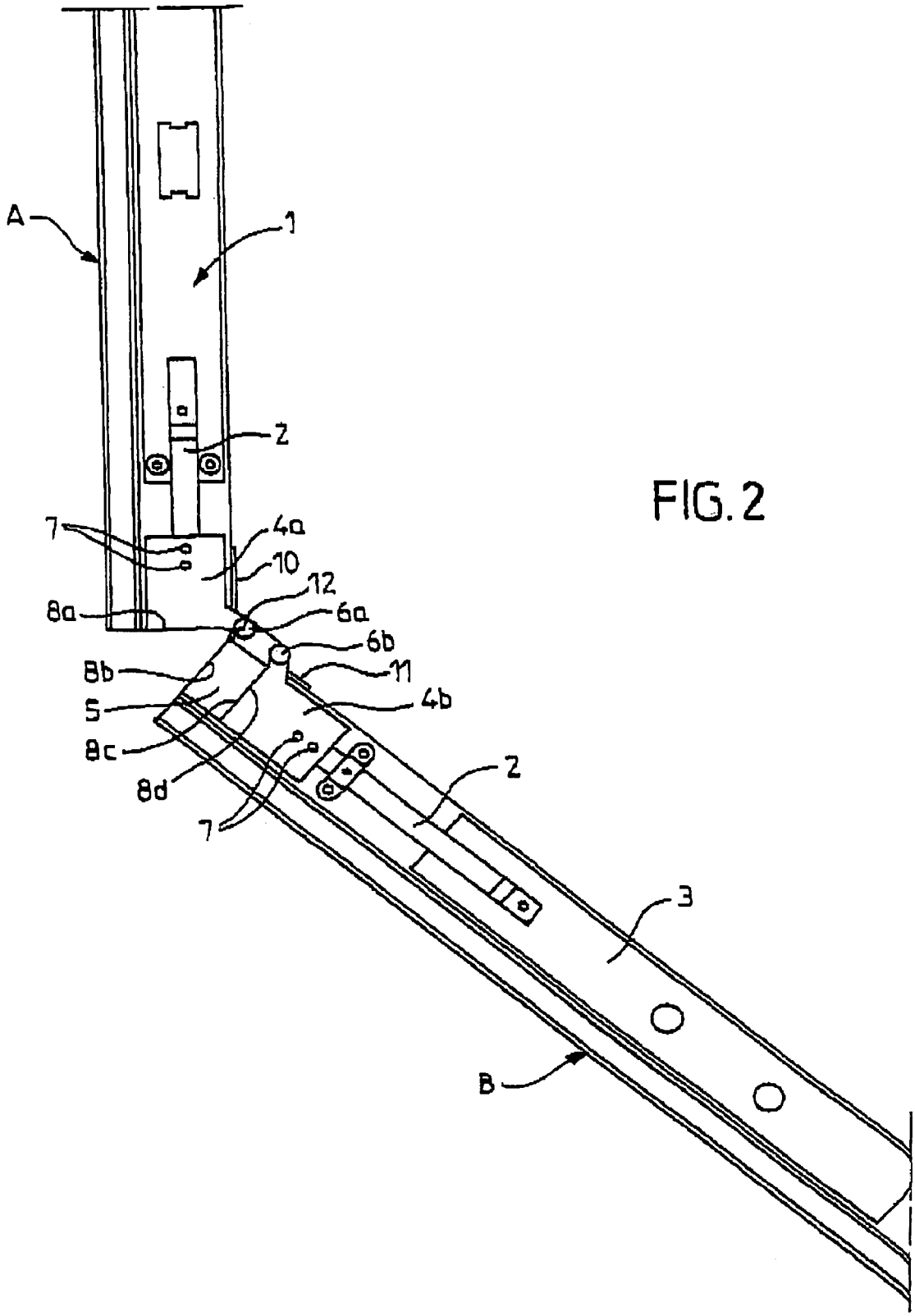
FIG. 2 shows schematically a side view of a closure with articulated panels, provided with a device according to the invention in the bolted position.

In FIG. 2, the sectional closure shown in the articulated position has a first section or panel A and a second section or panel B. The relative articulation of the panel sections A, B is achieved with a hinge fixed by tongues 10, 11 respectively to the interior surfaces of the panels A, B.

The geometric axis 12 of the hinge coincides in the position of FIG. 2 with the geometric axis of articulation 6*a* of the connecting member 5.

This position corresponds to the bolting of the opening in an articulated assembly, because the actuating blade is in its lower position, corresponding to the descent of the articulation 6*b* along the panel B.

In this position, the surfaces 8*a* and 8*b* form an angle between them, whilst the surfaces 8*c* and 8*d* remain pressed against each other, even in the articulated position.

To obtain the coincidence of the axis of the hinge of the panels A, B and the axis of articulation 6*a*, it is advantageous to provide by construction the positioning of the articulations 6*a*, 6*b* and the articulation of the hinge in a same plane.

Figure 3:
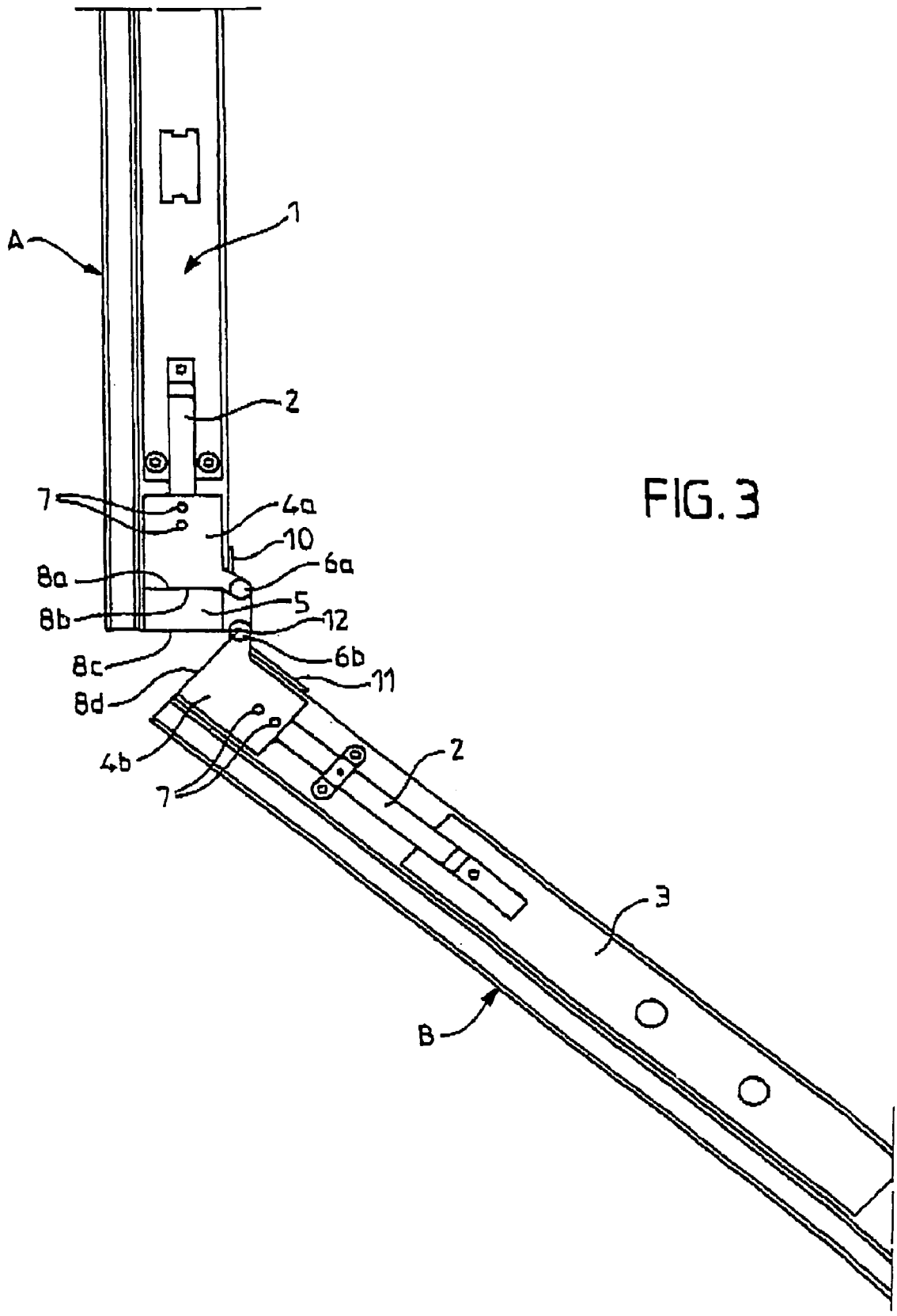
FIG. 3 shows schematically a side view of a closure with articulated panels, provided with a device according to the invention in the unbolted position.

In FIG. 3, a closure comprising the two articulated panels A, B is in the unbolted position, this position corresponding to the coincidence of the axis 12 of the articulation hinge and the articulation 6*b* of the connecting member 5.

In this position, the articulation 6*a* is raised to the upper position along the panel A.

The surfaces 8*a*, 8*b* remain pressed against each other, whilst the surfaces 8*c*, 8*d* form an angle of articulation between themselves.

To obtain simultaneously the coinciding relationships described with reference to FIGS. 2 and 3, it is preferably provided that the spacing of the articulations 6*a*, 6*b* corresponds to the path of the actuating blade 2 between its end positions of bolting and unbolting.

Figure 4:
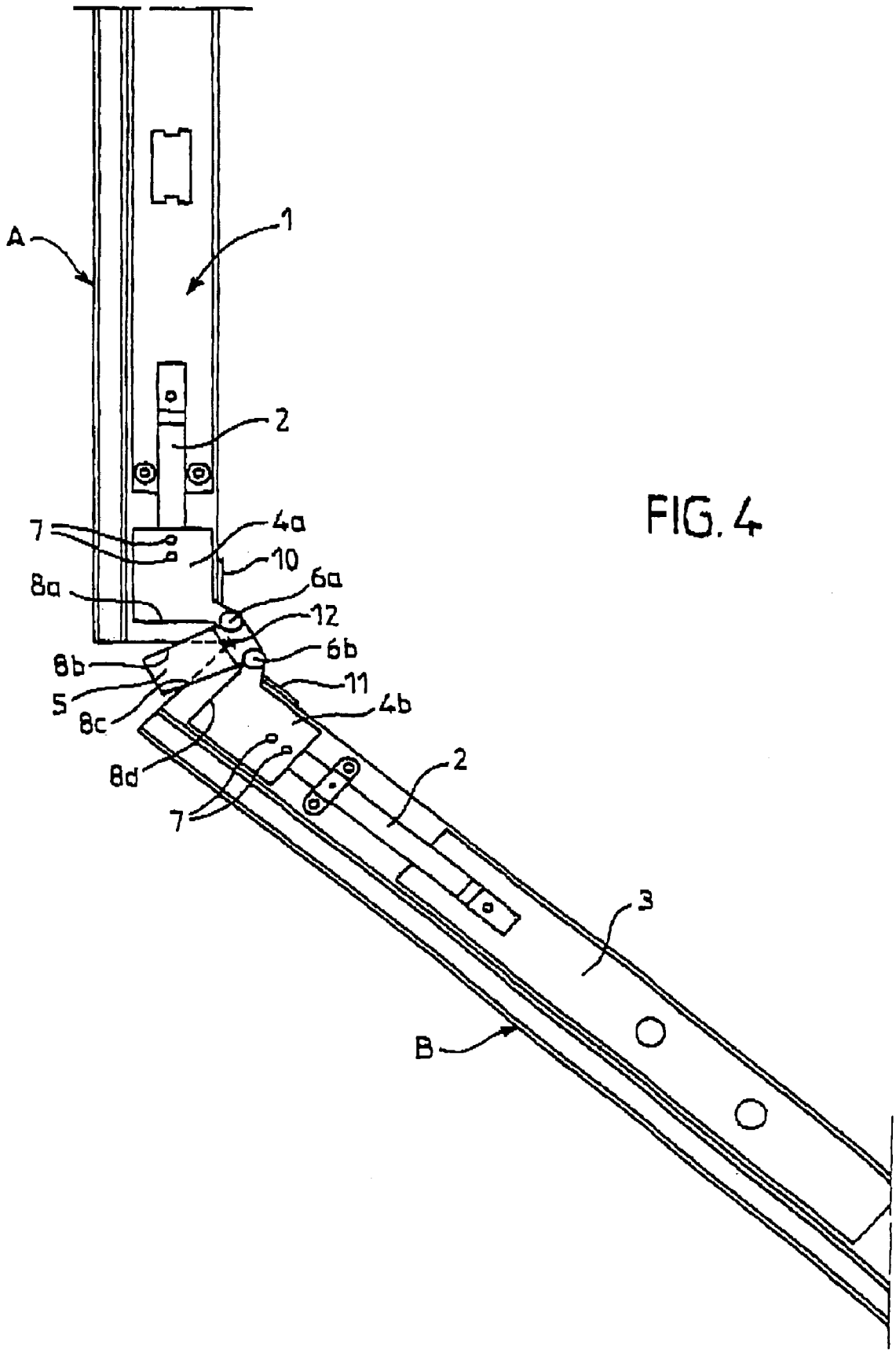
FIG. 4 shows schematically a side view of a closure with articulated panels, provided with a device according to the invention in an intermediate position.

In FIG. 4, the articulated closure with its panels A, B is shown in an intermediate position between bolting and unbolting.

In this intermediate position, the axis 12 of the hinge does not coincide either with the axis 6*a* or with the axis 6*b* of the connecting member 5.

The surfaces 8*a*, 8*b* form between them a first angle of articulation, whilst the surfaces 8*c*, 8*d* form between them a second angle of articulation. The sum of the first and second angles of articulation mentioned above is equal to the total angle of relative articulation of the panels A and B.

Because the connecting member 5 is doubly articulated, this double freedom of movement permits the complete release of the member 5 and does not give rise to any parasitic force on the articulations 6*a* and 6*b*.

Thus, according to the invention, the bolting and unbolting of a closure becomes possible even in the position of articulation; moreover, no parasitic force is transmitted to the mechanism of the device during this bolting and unbolting as shown in FIG. 4.

The invention described with reference to a particular embodiment is in no way limited, but on the contrary covers all modifications of shape and any modification of embodiment of the invention, the essential fact being that a double articulation connection permits simultaneously the articulation of the sections of the closure as well as its bolting and unbolting.

The three successive elements: portions 4*a*, 4*b* and member 5 are thus articulated according to the invention so as to follow the movement of the panels A, B, during opening and closing of a closure or a sectional door.

The articulation of the three successive elements: portion 4*a*, 4*b* and member 5, as well as the opening and closing of a closure or a sectional door, are carried out in the bolted and unbolted position, according to the invention.

The articulation of the three successive elements: portions 4*a*, 4*b* and member 5, permits the transmission of an axial force and permits the rotation of the panels A, B about their axis 12 of articulation.

When the closure or sectional door is closed, the three successive elements: portions 4*a*, 4*b* and member 5 are aligned. The three successive elements: portions 4*a*, 4*b* and member 5 thus coact by permitting the transmission of an axial force, which permits their movement and effectuates the bolting or unbolting of the device according to the invention.

During opening of the closure or sectional door, the panels A, B pivot about their geometric axis 12. The three successive elements: portions 4*a*, 4*b* and member 5 pivot about the axis 6*a* when the closure or sectional door is bolted, or about the axis 6*b* when the closure or sectional door is unbolted, according to the invention.

In these two cases, the pivoting and the raising of a sectional garage door, or a wide flap door, is possible.

In the case of an intermediate position, the axis of rotation of the panels A, B is located between the axes 6*a* and 6*b*. The articulation of the three successive elements: portions 4*a*, 4*b* and member 5 remains equally possible according to the invention, by means of the combined partial rotations about the axes 6*a* and 6*b*.

The invention claimed is:

1. A device for pivotally connecting two sections of a sectional closure, said device comprising:

a central connecting member;

a first actuating member pivotally connected to a first side of said central connecting member and having a first blade that mates with a bolting member on a first one of two sections of a sectional closure;

a second actuating member pivotally connected to a second side of said central connecting member and having a second blade that mates with a closure securing lock on a second one of two sections of a sectional closure, said first and second actuating members permitting articulation of first and second sections of a sectional closure at least in open and closed positions of the sectional closure.

2. The device according to claim 1, wherein a spacing between the first and second positions corresponds substantially to a length of a path of said central connecting member.

3. The device according to claim 1, wherein axes of articulation of said first and second members are substantially coplanar with an axis of articulation of the first and second sections, when the first and second sections are aligned.

4. The device according to claim 1, wherein said central connecting member constitutes an intermediate connecting rod in an aligned position of the first and second sections and an intermediate articulation rod in an articulated position of the first and second sections.

5. The device according to claim 1, wherein said central connecting member is a crosspiece with two surfaces for transmitting force adapted to coact with corresponding surfaces of said first and second actuating members.

6. The device according to claim 1, wherein an axis of articulation of the first and second sections is coincident with an axis of articulation with an axis of articulation of one of the first and second articulating members in an articulation position of the first and second sections, when the first and second sections are aligned and when the sectional closure is in bolted or unbolted positions.

7. The device according to claim 1, wherein the sectional closure is a sectional door.

8. The device according to claim 1, wherein the central bolting member is a lock.

9. A closure assembly for pivotally connecting two adjacent sections of a sectional closure, said assembly comprising:

first and second adjacent sections hingedly connected to each other;

a central connecting member between said first and second sections;

a first actuating member pivotally connected to a first side of said central connecting member and having a first blade that mates with a bolting member on said first section;

a second actuating member pivotally connected to a second side of said central connecting member and having a second blade that mates with a closure securing lock on said second section, said first and second actuating members permitting articulation of said first and second sections.

* * * * *